US005900827A

United States Patent [19]

Graham et al.

[11] Patent Number: 5,900,827

[45] **Date of Patent: * May 4, 1999**

[54] FLIGHT CREW RESPONSE MONITOR

[75] Inventors: Donald A. Graham, Redmond; Randall P. Robertson, Bellevue, both of Wash.

[73] Assignee: The Boeing Company, Seattle, Wash.

[ * ] Notice: This patent is subject to a terminal disclaimer.

[21] Appl. No.: 08/058,612

[22] Filed: May 6, 1993

Related U.S. Application Data

[63] Continuation-in-part of application No. 07/510,377, Apr. 17, 1990, Pat. No. 5,243,339, which is a continuation-in-part of application No. 07/203,367, Jun. 7, 1988, abandoned.

[51] Int. Cl.[6] ..... G08B 23/00

[52] U.S. Cl. ..... 340/963; 244/180; 340/945; 701/9; 701/14

[58] Field of Search ..... 340/945, 963, 340/964, 965, 967, 971, 974, 975, 977, 979, 575, 946; 364/427, 428, 429, 430, 431.02, 424.06, 431.01, 432, 439, 441, 447, 457, 462, 434, 433; 244/180, 181, 182, 183, 184, 185, 186, 191, 194, 175, 179; 701/9, 14, 15, 16

[56] References Cited

U.S. PATENT DOCUMENTS

| | | | |
|---|---|---|---|
| 1,881,878 | 10/1932 | Nidy . | |
| 3,355,705 | 11/1967 | Koerner . | |
| 3,355,706 | 11/1967 | Pitches . | |
| 3,715,718 | 2/1973 | Astengo . | |
| 3,877,466 | 4/1975 | Montor . | |
| 3,925,751 | 12/1975 | Bateman et al. . | |
| 3,947,809 | 3/1976 | Bateman . | |
| 4,196,412 | 4/1980 | Sluis et al. . | |
| 4,320,393 | 3/1982 | Engdahl | 340/600 |
| 4,546,353 | 10/1985 | Stockton | 340/966 |
| 4,604,611 | 8/1986 | Seko et al. | 340/576 |
| 4,706,072 | 11/1987 | Ikeyama | 340/576 |
| 4,750,127 | 6/1988 | Leslie et al. . | |
| 4,792,906 | 12/1988 | King et al. . | |
| 4,811,230 | 3/1989 | Graham et al. . | |
| 4,879,542 | 11/1989 | Elsey | 340/575 |
| 5,050,081 | 9/1991 | Abbott et al. . | |
| 5,057,834 | 10/1991 | Nordstrom | 340/963 |
| 5,243,339 | 9/1993 | Graham et al. | 340/945 |

FOREIGN PATENT DOCUMENTS

| | | | |
|---|---|---|---|
| 321595 | 1/1991 | Japan | 340/963 |

*Primary Examiner*—Brent A. Swarthout
*Attorney, Agent, or Firm*—Conrad O. Gardner

[57] ABSTRACT

Method and apparatus for measuring the alertness level of the flight crew of an aircraft and raising it when necessary. The system also detects departures from the planned flight profile and provides aural warning.

8 Claims, 6 Drawing Sheets

EFIS = ELECTRONIC FLIGHT INSTRUMENT SYSTEM
EICAS = ENGINE INDICATION & CREW ALERTING SYSTEM
MSP = MODE CONTROL PANEL
CDU = CONTROL DISPLAY UNIT
FMC = FLIGHT MANAGEMENT COMPUTER
COMM = COMMUNICATION PANEL

ROUTE DEVIATION MONITOR LOGIC

PROFILE DEVIATION MONITOR LOGIC

AUTOPILOT DEVIATION MONITOR LOGIC

FLIGHT CREW RESPONSE MONITOR

REFERENCE TO RELATED APPLICATIONS

This is a continuation-in-part of Ser. No. 07/510,377 filed Apr. 17, 1990, now U.S. Pat. No. 5,243,339 which is a continuation-in-part of Ser. No. 07/203,367 (abandoned), filed Jun. 7, 1988.

BACKGROUND OF THE INVENTION

The present invention relates to monitors, and more particularly, to a flight crew response monitor for detecting an inattentive aircraft flight crew and raising their alertness level when required.

Long range flights involve hours of low crew activity during the cruise phase. With modern navigation and flight management systems, the crew role becomes one of monitoring progress and making position reports when crossing pre-established reporting points. The resulting boredom coupled with good equipment reliability can undermine the crew's attentiveness to flight status and progress. Furthermore, crew scheduling unavoidably exposes many crews to the adverse physiological effects of jet lag. Consequently, at least one pilot will often fall asleep during a long cruise segment, particularly when flying into the sun. In spite of his best effort to stay awake, it is suspected that a second pilot will occasionally doze off as well. This can result in a reporting point being missed or overshooting the point at which the descent should be initiated (top of descent) with the flight management system functioning normally. More importantly, a subtle equipment failure going undetected can result in wandering off course, departing the assigned altitude or upsetting airplane attitude to the point of requiring a dive recovery.

Although modern aircraft have crew alerting systems which provide prioritized alerts to the crew of detected failures, they do not detect all causes of departure from the planned flight profile. Even detected and annunciated failures may not be caught by an inattentive crew until the situation has substantially deteriorated. It has been recognized for some time that the solution lies in being able to measure the level of crew alertness and raise it when necessary.

Proposed solutions have ranged from a timer generated alarm to random questions on a display which require the pilot to respond, even though he may be busy doing something else. They have the shortcoming that they would very likely become an aggravation to an alert crewman. Nor do they alert the crew to a gradual departure from the programmed flight profile.

Prior art patent literature has included U.S. Pat. No. 3,312,508 to Keller et al., U.S. Pat. No. 3,922,665 to Curry et al. and U.S. Pat. No. 4,679,648 to Johansen which require a special physical response (pushing of button) from the operator to avoid an alert. In contrast, the present system normally requires no special response from an active crew to avoid an alert. In addition, these patents do not address the problem of drawing attention to subtle failures which an inattentive crew might not detect in a timely manner. Also the patent literature has included U.S. Pat. No. 3,925,751 to Bateman et al. and U.S. Pat. No. 3,947,809 to Bateman which relate to deviations from glideslope path not addressed by the present system.

SUMMARY OF THE INVENTION

A first object of the present invention is to provide flight crew response monitoring which is invisible to the active crew.

It is a further object of the present invention to provide flight crew response monitoring which is inhibited except during cruise segments.

It is yet another object of the present invention to provide monitoring of autoflight performance when engaged.

It is still another object of the present invention to provide a monitoring system which monitors crew attentiveness at top of descent.

It is still a further object of the present invention to provide a system which detects departures from the programmed profile and provides immediate warning to the crew.

It is another object of the present invention to provide monitoring beginning with an unobtrusive message and escalating to a wake-up warning if necessary when dual pilot inattentiveness is detected.

In accordance with a preferred embodiment of the invention, there is provided a method for measuring the alertness level of the flight crew of an aircraft and raising it when necessary. Additionally, the present system utilizes detection of departures from the planned flight profile and generates graduated level warnings to the crew.

DESCRIPTION OF THE PREFERRED EMBODIMENTS

Figure 1:
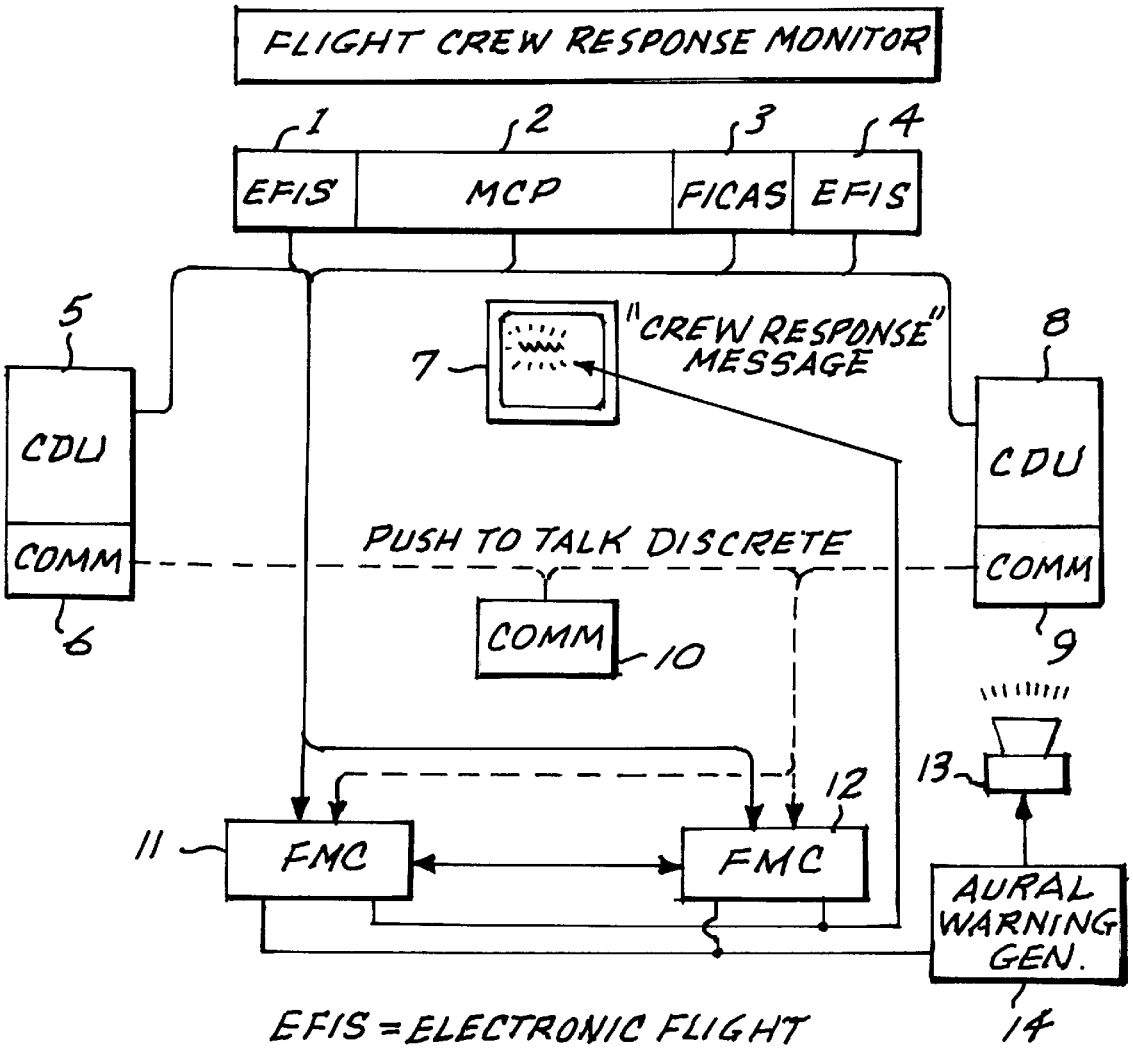
FIG. 1 is a block diagram and schematic showing the present Flight Crew Response Monitor (FCRM) which utilizes Flight Management Computer (FMC) systems.

The Flight Crew Response Monitor (FCRM), shown schematically in FIG. 1, utilizes Flight Management Computer (FMC) hardware 11 and 12 utilized at present on commercial aircraft. The FMC derives a horizontal route over the earth's surface based on pilot selected way points, airways and terminal area procedures which the pilot can then select as the active route to be flown. Furthermore, the pilot can command the FMC to control the aircraft to follow this active route by engaging the FMC lateral navigation (LNAV) mode. With LNAV engaged, the FMC sends roll control signals to the auto pilot which thereby controls the direction of flight. The FMC also computes the optimum vertical profile, subject to pilot modification, including optimum speeds, cruise altitudes and the optimum point at which to begin the descent from cruise to arrive at the runway with minimum fuel wastage. This optimum point is referred to as the top of descent point. The pilot can command the FMC to control the aircraft to follow the optimum or pilot modified vertical profile by engaging the FMC vertical navigation (VNAV) mode. With VNAV engaged, the FMCs send pitch control signals to the auto pilot, and thrust or speed control signals to the auto throttle, which thereby control the speed and altitude of the aircraft. Software is added to the FMCs to provide profile departure detection, crew activity and flight progress monitoring, and alert triggering. Discrete signals are passed to crew alerting display 7 and warning system 14 which generate visual and aural alerts respectively. Discrete signals from communications panels 6, 9, and 10 to the FMCs are added to identify when a pilot is talking on a radio.

Logic is implemented in the FMCs because they already compute the planned lateral route and vertical flight profile and because they receive the signal inputs needed to detect crew activity. Specifically, as shown in FIG. 1 they receive digital signals indicating any pilot switch actuation on EFIS control panels 1 and 4, Mode Control Panel 2, EICAS control panel 3, Control Display Units 5 and 8 and communications panels 6, 9, and 10. The added logic is described in FIGS. 2 through 6.

Figure 2:
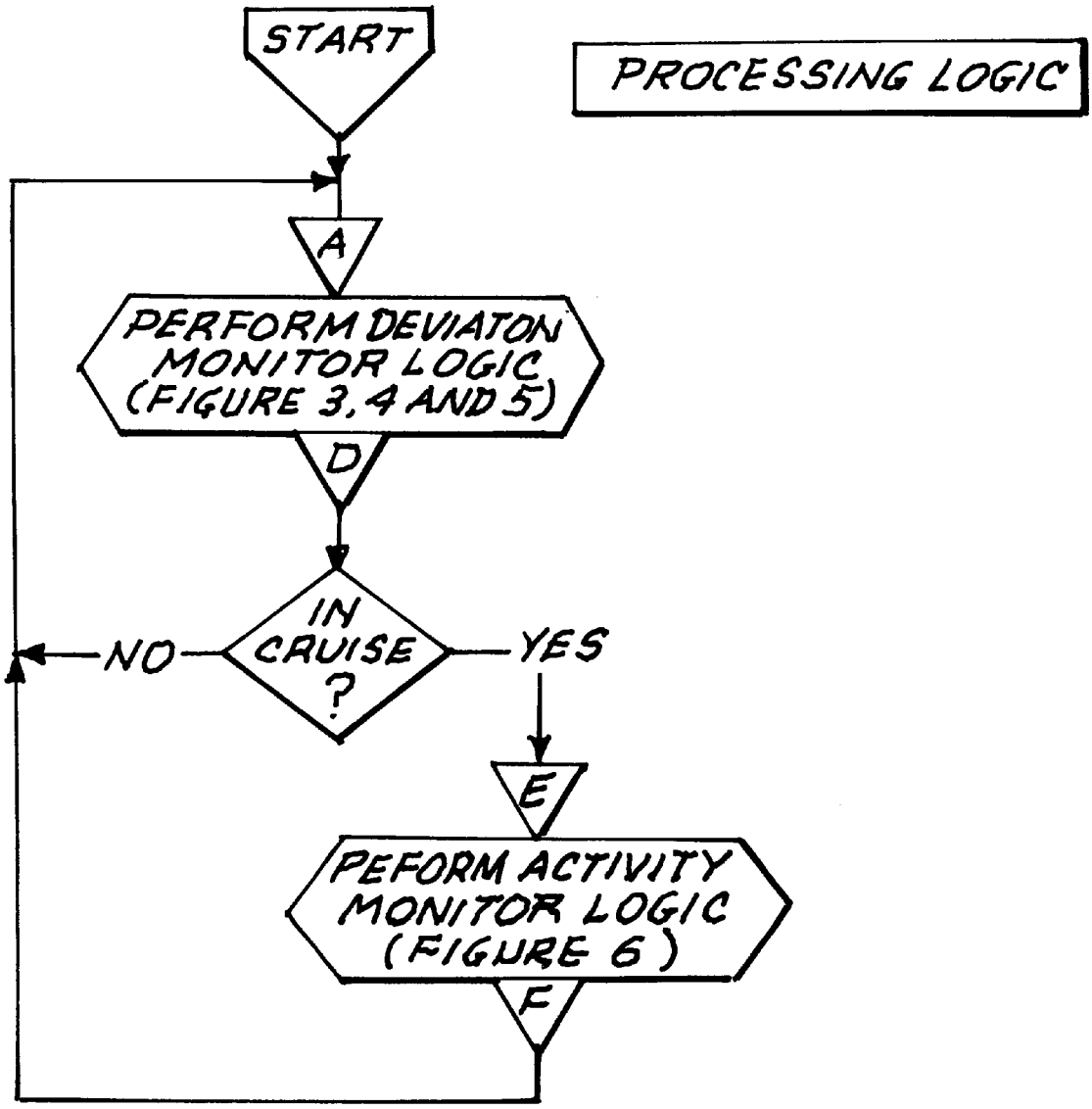
FIG. 2 is a flow chart showing the overall processing logic utilized during flight of the aircraft.

FIG. 2 shows the overall processing logic which would be employed in flight. The FMCs would cycle through the logic approximately once per second, with the deviation monitor logic being invoked on each pass and the crew activity monitor invoked only during cruise.

Figure 3:
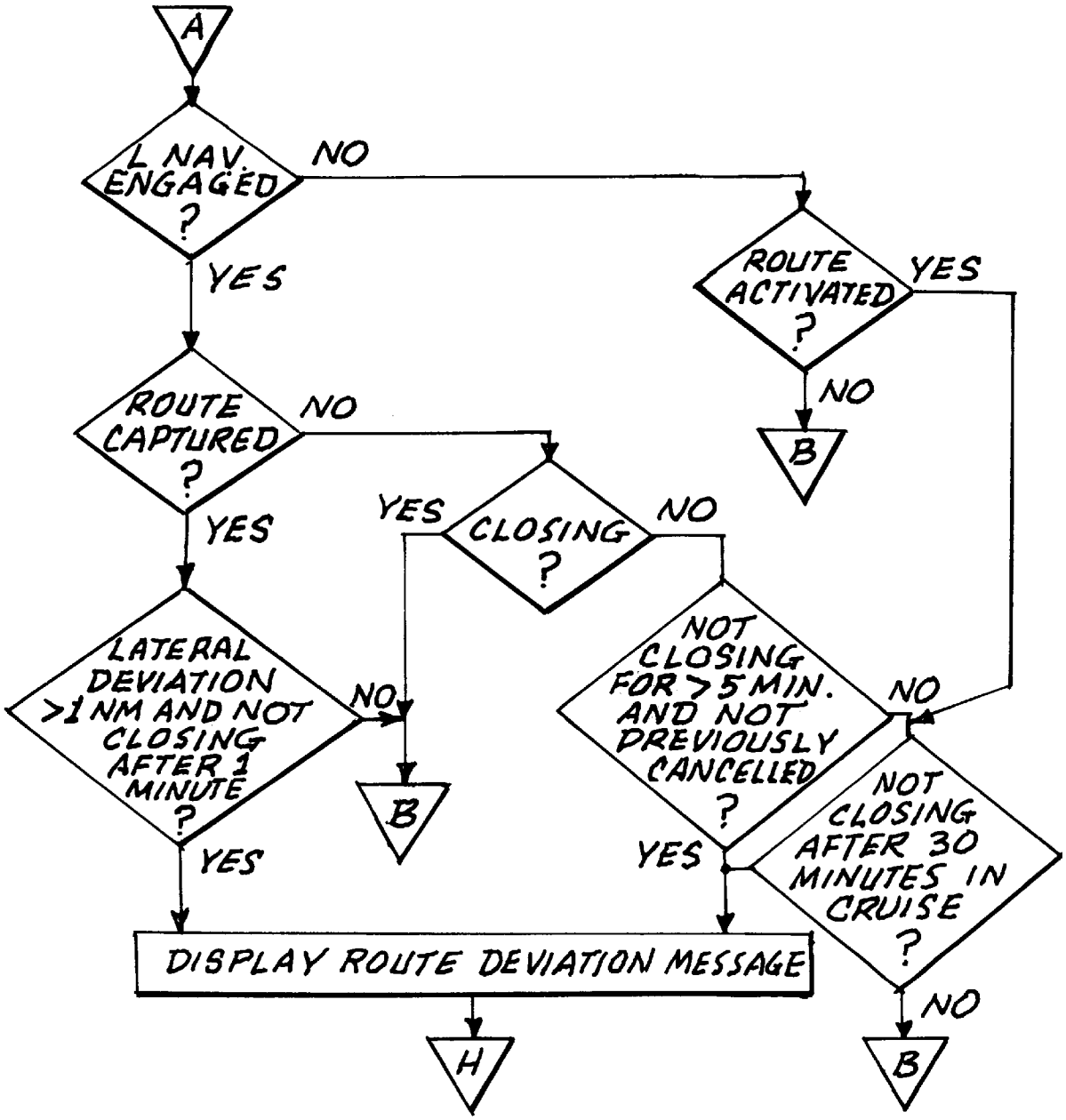
FIG. 3 is a flow chart schematically showing operation of the flight crew response monitor logic during route deviation.

The route deviation monitor described in FIG. 3 is invoked inflight whenever an FMC computed route has been activated. It is designed to trigger the crew response alert when the airplane:

1. Begins to fly away from a previously captured route with the FMC lateral navigation mode (LNAV) engaged.
2. Is not closing with the route for over five minutes with LNAV armed. (Pilot cancelable for up to 30 minutes).
3. Has been in the cruise phase without LNAV engaged but with an active route, and has not been closing with that route for more than 30 minutes.

The first condition would result from an FMC or auto pilot inability to stay on course. The last two guard against the crew getting side-tracked and neglecting to capture the active route.

Figure 4:
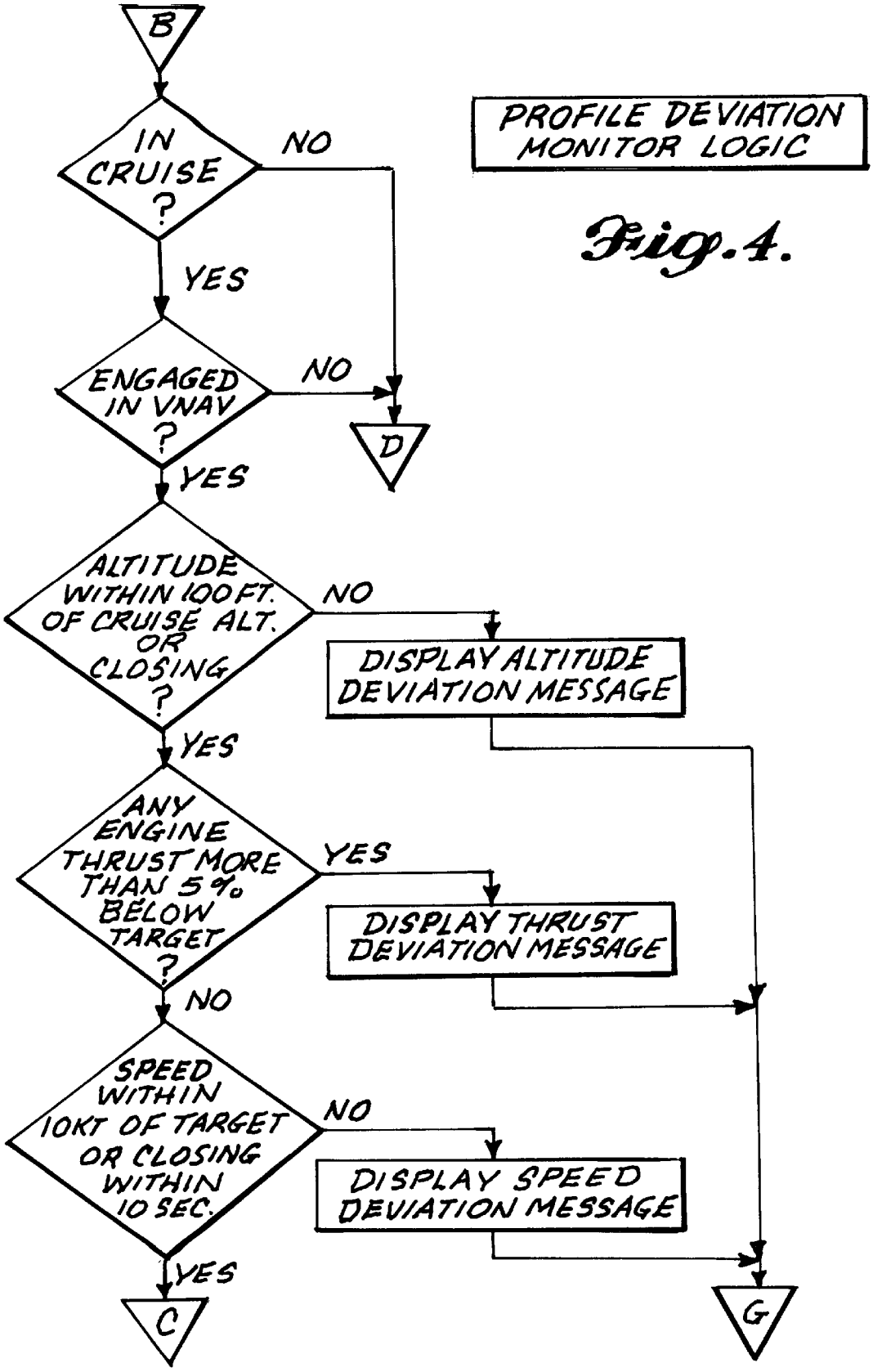
FIG. 4 is a flow chart schematically showing the operations of the profile deviation monitor logic utilized during cruise when engaged in the FMC vertical navigation mode (VNAV)

The profile deviation monitor described in FIG. 4 is invoked during cruise when engaged in the FMC vertical navigation mode (VNAV). In this situation, the FMC controls pitch and thrust, thereby controlling speed and altitude. It captures and holds the scheduled cruise altitude and speed. An altitude deviation message is generated if it fails to close with the cruise altitude or deviates more than 100 feet after closing, regardless of whether the cause is lack of control or lack of airplane performance capability. Jet engines have been known to gradually lose thrust in a way which might go undetected by an inattentive crew until performance deterioration forces a recovery maneuver to be flown. For earlier crew awareness, a thrust deviation message is generated when an engine is unable to deliver at least 95% of target thrust. Similarly, a speed deviation message is generated when the airplane is unable to close to and maintain target speed within ten knots. When any of these deviation messages are generated, the crew response warning is immediately triggered.

Figure 5:
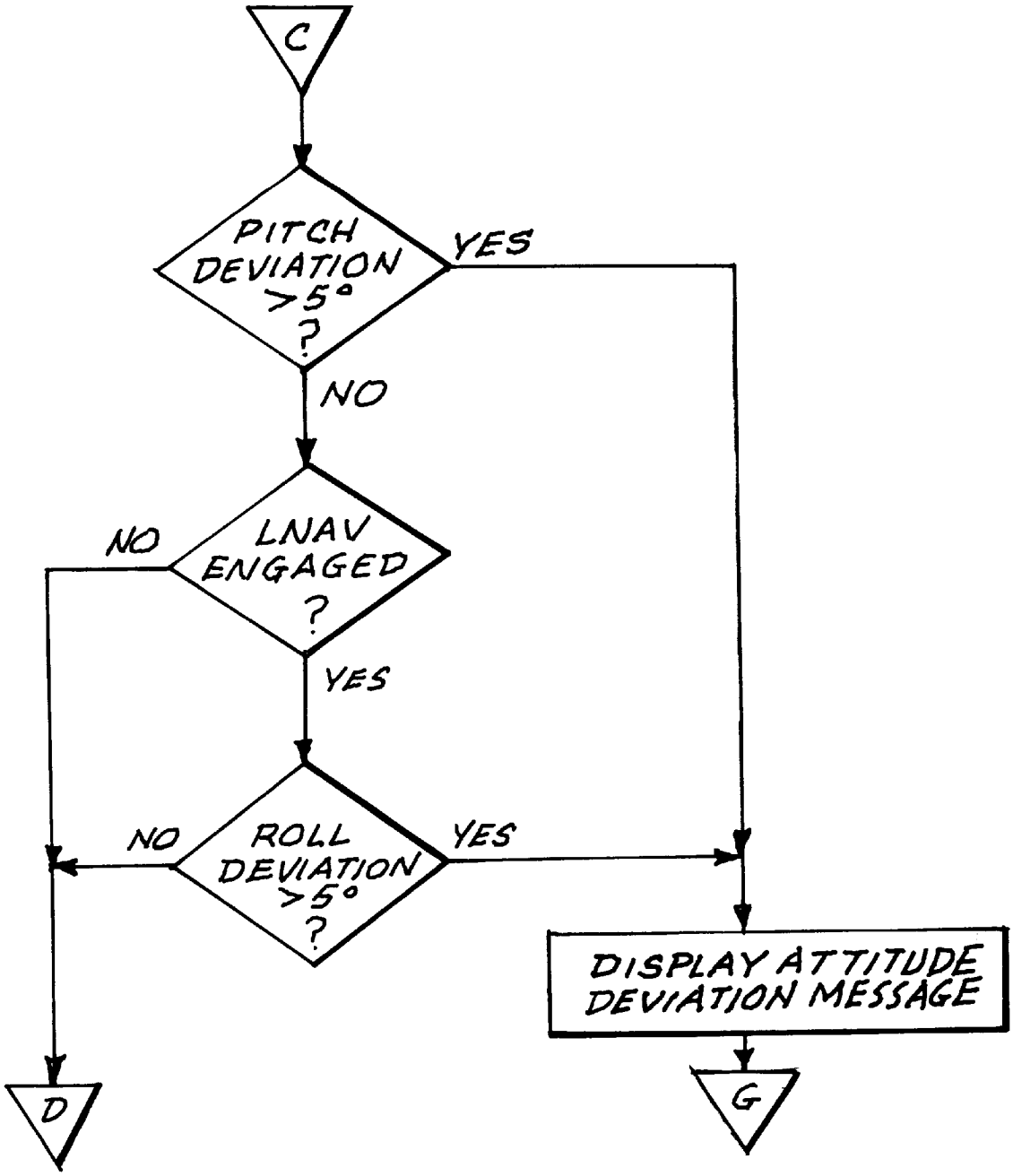
FIG. 5 is a flow chart schematically showing the auto pilot deviation monitor logic and, FIG. 6 is a flow chart schematically showing operation of the activity monitor logic of the present flight crew response monitor system.

The auto pilot's ability to control pitch and roll to the FMC command values is monitored as shown in FIG. 5. When an attitude deviation message is generated, the crew response warning is also triggered since the cause may be airplane related and therefore not generating a separate crew alert.

On modern jet transports designed for operation with a flight crew of two pilots, most pilot interface activity with the airplane during cruise involves the control panels 1, 2, 3, 4, 5, 6, 8, 9 and 10 in FIG. 1. Control panels 1, 2, 3, 4, 5, and 8 transmit all switch positions except display brightness setting to the FMCs 11 and 12 over digital busses. Control panels 6, 9, and 10 send an analog discrete signal to the FMCs when they detect that a pilot has actuated a "press to talk" microphone switch. Tasks accomplished usually involve display manipulation, automatic flight mode selection, keyboard communication with the FMCs and voice communication over the radios, all of which result in signal changes which are detected by the FMC activity monitor, whose logic is described in FIG. 6. Consequently, it is realistic to assume that an alert crew will perform at least one of these tasks within a twenty minute period during cruise. The activity monitor operates on the principle that if a pilot action is sensed during this period via the FMC inputs shown in FIG. 1, at least one pilot is alert and the timer can be reset to zero. Since it is unlikely that both pilots will sit for twenty minutes without doing something which will automatically reset the timer, the system will normally be invisible to an alert crew.

It is possible, of course, for the timer to reach twenty minutes of sensed inactivity with an alert crew. They could be performing a satisfactory panel scan without touching the monitored controls. They might be performing tasks using unmonitored controls, conversing with each other, reading or just watching progress. There are very few tasks using unmonitored controls which can attract their attention for a significant time period. Since management of airplane subsystems is almost entirely automatic, most of the overhead panel remains untouched inflight. Of course, additional control panel outputs could be monitored. Studies to date indicate that should not be necessary. If the timer should reach twenty minutes, a silent visual advisory alert is triggered identifying the need for a "crew response" to avoid the aural warning. An alert pilot should notice this advisory and can then move any one of the monitored controls to reset the timer.

If both pilots happened to be asleep when arriving at the top of descent location, they could overfly it without requesting a descent clearance or responding to an ATC clearance to descend. Continued cruise can result in an airspace violation and could seriously deplete the reserve fuel intended to cover the contingency of having to divert to an alternate. To preclude prolonged overflight, the crew response advisory is triggered upon passing the top of descent location, calculated by the FMC as appropriate for descent to the preselected destination airport, if the timer has reached at least ten minutes. In this case, the FMC activity monitor is used to measure crew inactivity leading up to the trigger point; namely, passing the top of descent location. The shorter time interval is used because the crew should have been planning the descent and requesting a clearance in this time period.

Figure 6:
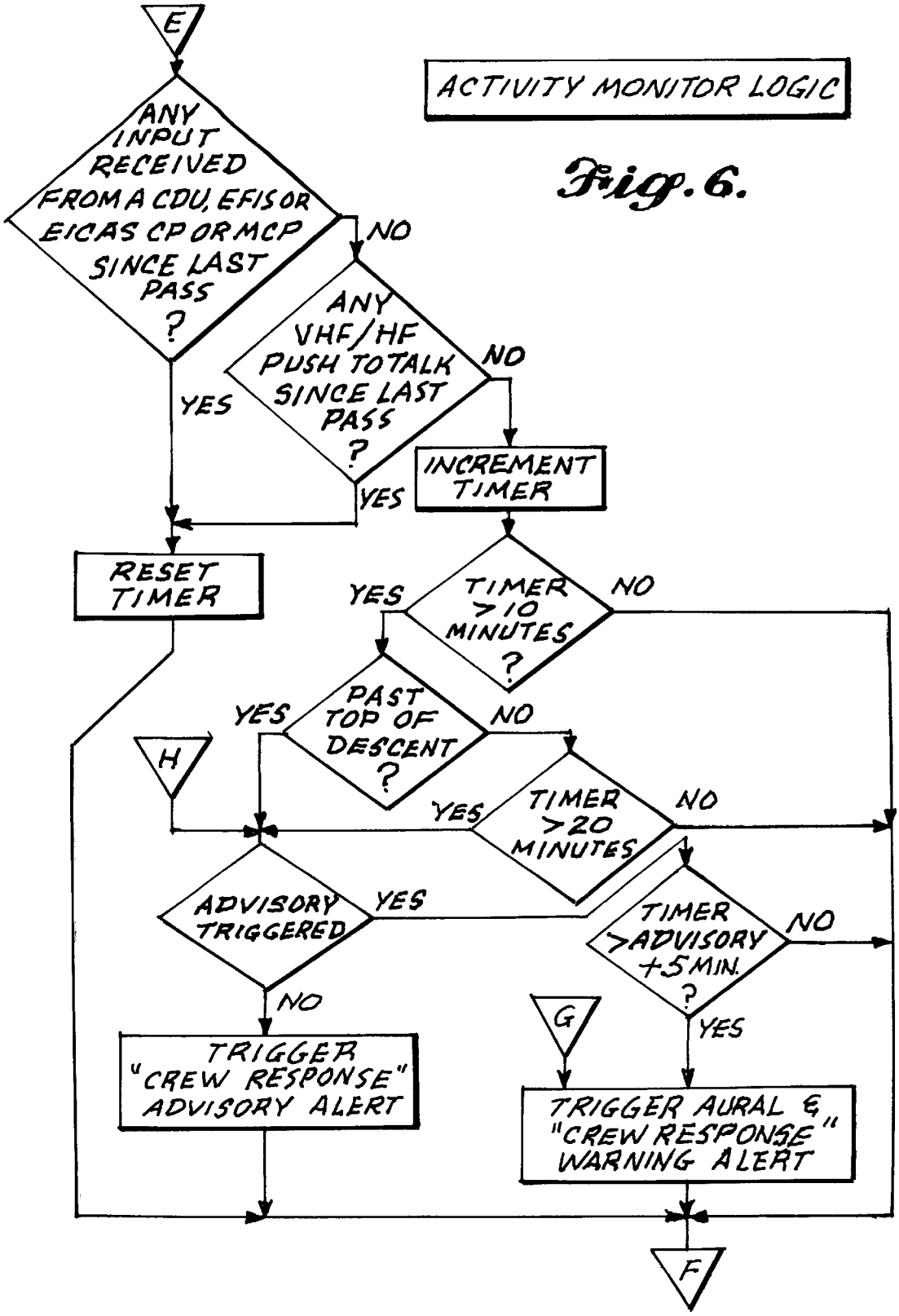

As FIG. 6 shows, if no crew activity is detected within five minutes after the silent "crew response" advisory is triggered, the aural warning is triggered. This continuous aural is sufficient to wake a pilot under any circumstance. It is silenced in the normal fashion for aural alerts.

Throughout this description, realistic timing and threshold values have been used. However, they will be refined during development testing and may even become airline variable in some cases.

What is claimed is:

1. A method of flight crew alertness monitoring for an aircraft having a Flight Management computer (FMC) which requires no crew action other than normal flight crew activities comprising a silent visual flight crew response advisory alert when no flight crew actuation of any of the controls monitored by the FMC has been detected by the FMC within a predetermined time period during the cruise segment.

2. The invention according to claim 1 wherein said predetermined time period is about 20 minutes.

3. A method of flight crew alertness monitoring for an aircraft having a Flight Management Computer (FMC) which requires no crew action other than normal flight crew activities comprising triggering an aural flight crew response alert when no flight crew actuation of any of the controls monitored by the FMC has been detected by the FMC within a predetermined time period after a silent flight crew advisory alert has been issued.

4. The invention according to claim 3 wherein said predetermined time period is about five minutes.

5. A method of flight crew response monitoring for an aircraft having a Flight Management Computer (FMC) for deriving current aircraft position and a horizontal route over the earth's surface which can be selected and activated by a pilot, to provide an active route to be flown, said method comprising triggering a flight crew response alert when:

said aircraft position is not converging with said active route for a predetermined time period with the FMC controlled laterial navigation mode (LNAV) armed, or said aircraft position begins to deviate from a previously captured active route with LNAV engaged, or said aircraft has been in the cruise phase with a route activated in the FMC but without LNAV engaged or armed, and has not been converging with said active route for a further predetermined time period.

6. The method according to claim 5 wherein said predetermined time period exceeds about fifteen (15) minutes.

7. A method of flight crew response monitoring for an aircraft having a Flight Management Computer (FMC) controlled vertical navigation mode (VNAV) and an FMC derived flight profile, said method comprising triggering a flight crew response alert during aircraft cruise with the FMC controlled vertical navigation mode (VNAV) engaged when the FMC detects that continued tracking of the FMC derived flight profile is jeopardized by either:

a gradual thrust loss to a predetermined percentage on any engine, or a speed deviation from target speed of more than a predetermined amount and said speed deviation is not decreasing for a predetermined time period, or a pitch deviation in excess of a predetermined number of degrees from FMC commanded pitch attitude, or a roll deviation in excess of a predetermined number of degrees from FMC commanded roll attitude.

8. The method according to claim 7 wherein said predetermined percentage is about five (5) percent, said predetermined amount is about ten (10) knots, said predetermined time period is five (5) minutes, and said predetermined number of degrees is about five (5) degrees.

* * * * *